US007770743B1

(12) United States Patent
Janowak et al.

(10) Patent No.: US 7,770,743 B1
(45) Date of Patent: Aug. 10, 2010

(54) SUPPORT STRUCTURE FOR HANGING PLANTS

(76) Inventors: Matt Janowak, 11311 Fawn Valley Trail, Fenton, MI (US) 48430; Gary Lowell, 323 Kendry Ct., Bloomfield Hills, MI (US) 48302

( * ) Notice: Subject to any disclaimer, the term of this patent is extended or adjusted under 35 U.S.C. 154(b) by 186 days.

(21) Appl. No.: 12/041,256

(22) Filed: Mar. 3, 2008
(Under 37 CFR 1.47)

(51) Int. Cl.
*A47G 7/00* (2006.01)

(52) U.S. Cl. ..... 211/119.12; 47/67; 211/189; 211/118; 211/204; 211/206; 108/92

(58) Field of Classification Search ..... 211/189, 211/853.23, 113, 118, 119.12, 126.2, 126.9, 211/128.1, 133.1, 133.2, 186, 188, 191, 194, 211/204, 206, 85.23; 47/67, 39, 82, 83; 108/92, 108/101, 180, 182, 186, 149; 248/152
See application file for complete search history.

(56) References Cited

U.S. PATENT DOCUMENTS

| | | | | |
|---|---|---|---|---|
| RE1,630 | E | 3/1864 | Wickersham | |
| 405,264 | A | 6/1889 | Lindsay | |
| 860,278 | A | 7/1907 | Botkin | |
| 1,410,740 | A | 3/1922 | Elgin | |
| 3,503,525 | A * | 3/1970 | Loebner | 211/206 |
| 4,122,781 | A * | 10/1978 | Potter | 108/101 |
| 5,579,702 | A * | 12/1996 | Aho | 108/92 |
| 5,584,141 | A * | 12/1996 | Johnson | 47/65 |
| 6,082,068 | A | 7/2000 | Fisher | |
| 6,216,889 | B1 | 4/2001 | Chang | |
| 6,413,004 | B1 * | 7/2002 | Lin | 403/176 |
| 6,536,717 | B2 * | 3/2003 | Parker | 248/49 |
| 6,854,919 | B2 | 2/2005 | Neumann et al. | |
| 2003/0024159 | A1 * | 2/2003 | Nakamura | 47/39 |
| 2005/0039390 | A1 * | 2/2005 | Sharples et al. | 47/39 |
| 2006/0037238 | A1 * | 2/2006 | Sharples et al. | 47/39 |

* cited by examiner

*Primary Examiner*—Darnell M Jayne
*Assistant Examiner*—Patrick Hawn
(74) *Attorney, Agent, or Firm*—Young & Basile, P.C.

(57) ABSTRACT

A support structure for hanging plants. The support structure includes a plurality of frames having a plurality of clamping sites formed thereon and a plurality of mounting members formed thereon. A plurality of rods are supported by the frames for suspending the hanging plants therefrom, wherein at least two frames support each rod. A plurality of clamping members are connectable to a respective clamping site for securing the rods to the frames. The frames are supported by a base portion, wherein a plurality of elongate support members extend between the base portion and the frames to hold the frames above the base portion.

15 Claims, 8 Drawing Sheets

SUPPORT STRUCTURE FOR HANGING PLANTS

FIELD OF THE INVENTION

The present invention relates to the field of support structures, and more particularly, the present invention relates to a support structure for hanging plants.

BACKGROUND OF THE INVENTION

In a retail environment, efficient use of space is vital to profitability. For this reason, retailers expend significant amounts of time and money designing and building retail displays that maximize selling space. Retailers that specialize in the sale of live plants face significant difficulty in constructing efficient and attractive retail displays. For instance, the bulk and weight of live plants requires a strong shelving construction, while proper plant care requires a structure that is water resistant and able to drain. Additionally, due to the seasonal nature of live plant sales, retail plant displays are usually disassembled and stored off-season.

One traditional method for displaying live plants in retail environments comprises constructing simple benches or tables from available materials. However, these benches or tables are often heavy, unattractive, prone to water damage, and difficult to clean. The assignee of the present invention has previously addressed some of the above issues, by way of its U.S. Pat. No. 5,579,702, entitled "Shelving Construction."

One way in which retailers that specialize in the sale of live plants have attempted to maximize selling space and profitability is by selling prearranged hanging baskets of live flowers and complimentary plants. It is particularly attractive for retailers to suspend hanging baskets above shelving units where potted live plants are displayed for sale, thus converting otherwise unused space into profitable selling space. However, display of hanging plant baskets in a retail setting remains a problem due to the size and bulk of the baskets, and the number of hanging baskets that may be displayed above a typical shelving unit is thus limited to ensure stability of the overall shelving unit. Accordingly, it remains difficult to display hanging baskets in an efficient and attractive manner.

It would be desirable to have support structure for hanging plants that is modular, sturdy, and allows attractive and organized product presentation.

BRIEF SUMMARY OF THE INVENTION

The present invention provides a support structure for hanging plants. The support structure includes a plurality of frames having a plurality of clamping sites formed thereon and a plurality of mounting members formed thereon. A plurality of rods are supported by the frames for suspending the hanging plants therefrom, wherein at least two frames support each rod. A plurality of clamping members are connectable to a respective clamping site for securing the rods to the frames. The frames are supported by a base portion, wherein a plurality of elongate support members extend between the base portion and the frames to hold the frames above the base portion.

The plurality of frames may be substantially triangular, and thus, the plurality of clamping sites may have three clamping sites spaced from one another in a substantially triangular configuration. Furthermore, the plurality of frames may be fabricated as integrally formed molded plastic bodies.

The mounting members of the frames are connected to the upper ends of the elongate support members by friction fit.

Furthermore, the base portion may engage each elongate support member at an intermediate point thereon to restrain the elongate support members against rotation with respect to the base portion. In an alternative embodiment of the mounting members, a resilient flange may be provided on each mounting member for frictionally engaging a respective elongate support member.

BRIEF DESCRIPTION OF THE DRAWINGS

The description herein makes reference to the accompanying drawings wherein like referenced numerals refer to like parts throughout several views and wherein.

DETAILED DESCRIPTION OF THE INVENTION

Figure 1:
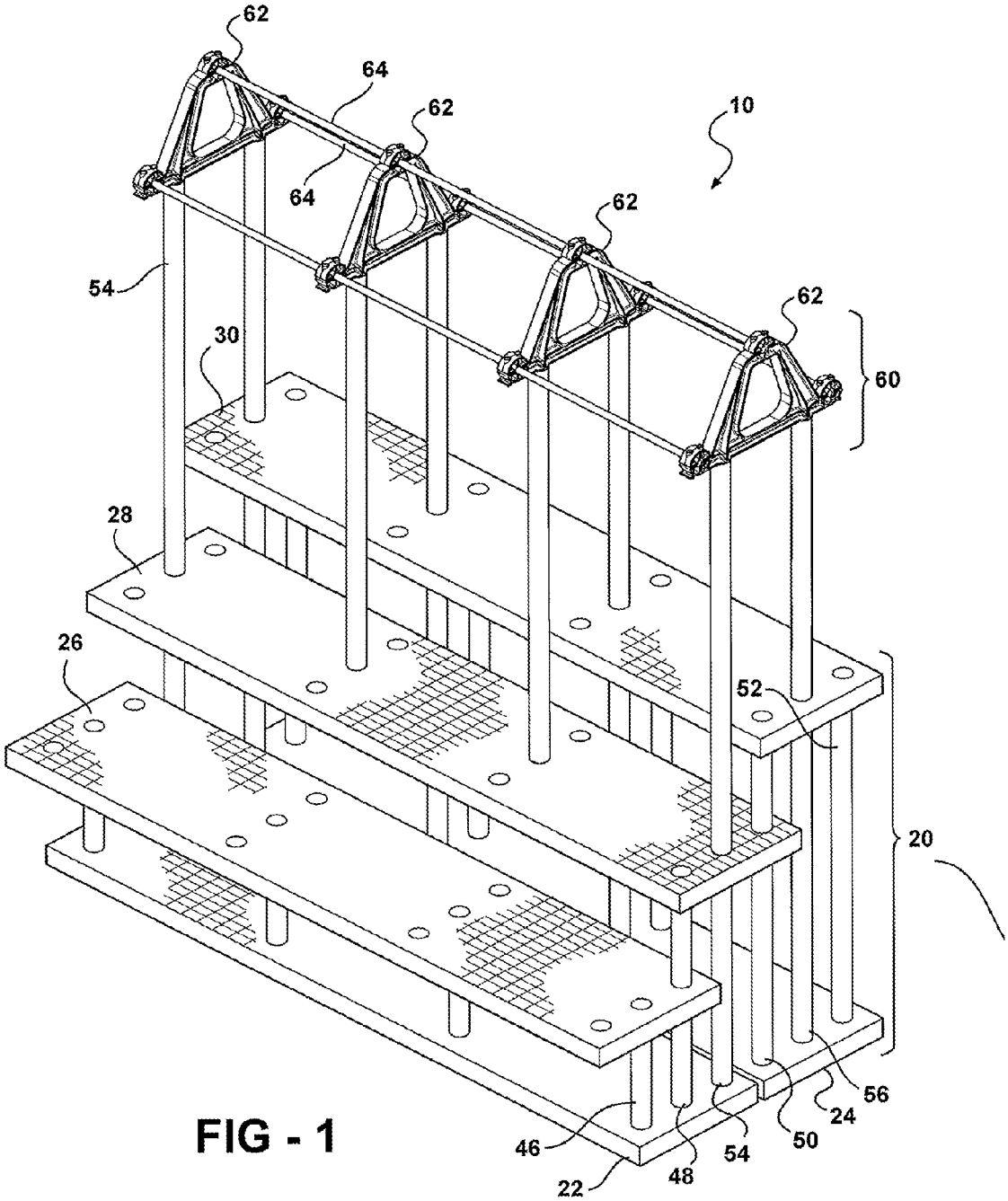
FIG. 1 is a perspective view of a support structure for hanging plants of the present invention.

Referring to the drawings, the present invention will now be described in detail with reference to the preferred embodiment.

FIG. 1 shows a support structure 10 for hanging plants (not shown) of the present invention. The support structure 10 includes a shelving unit 20 and a plant hanger assembly 60. The plant hanger assembly 60 is comprised of a plurality of frames 62 and a plurality of elongate, substantially horizontal support rods 64 which each extend along a longitudinal rod axis 64*a*, and on which the hanging plants may be supported. The shelving unit 20 serves as a base for the plant hanger assembly 60, and a plurality of uprights 54, 56 extend upward from the shelving unit 20 to support the plurality of frames 62.

The shelving unit 20 includes a plurality elongate panels that are substantially similar in construction to one another, namely a first base panel 22, a second base panel 24, a first riser panel 26, a second riser panel 28 and a third riser panel 30. The panels 22, 24, 26, 28, 30 are fabricated from a strong and durable plastic material, such as high density polyethylene, and may be formed by a number of well known methods, such as injection molding. The panels 22, 24, 26, 28, 30 are connected to one another by a plurality of substantially tubular support legs, namely a first support leg 46, a second support leg 48, a third support leg 50, and a fourth support leg 52. The support legs 46, 48, 50, 52 are rigid, hollow, substantially cylindrical, and may be fabricated from any suitable material, such as metal or plastic. The 22, 24, 26, 28, 30 further serve to support and stabilize the uprights 54, 56, which are substantially similar in construction the support legs 46, 48, 50, 52.

Figure 3:
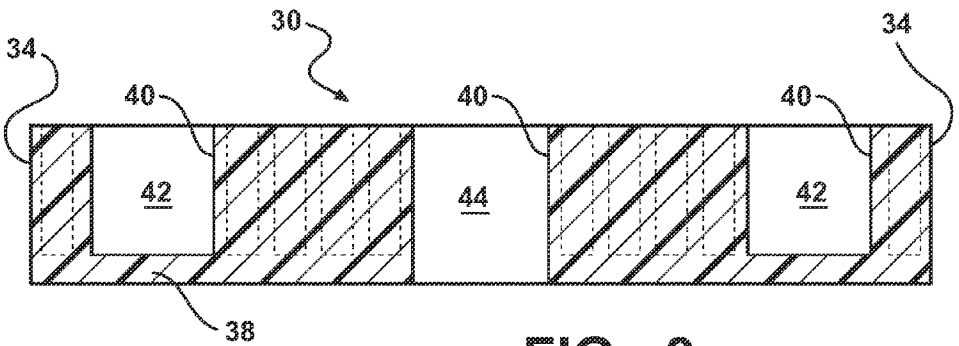
FIG. 3 is a section view of the riser panel.
Figure 4:
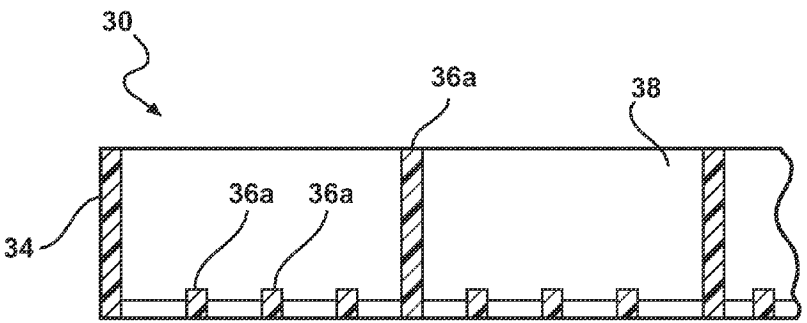
FIG. 4 is a section view of the riser panel.
Figure 2:
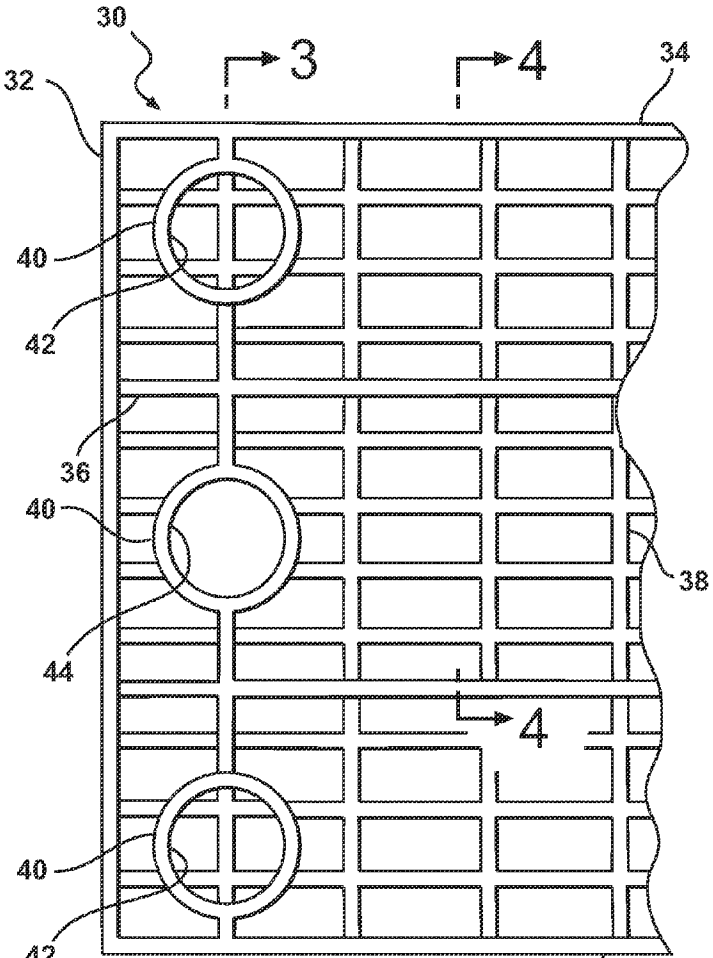
FIG. 2 is a bottom view of a riser panel of the support structure for hanging plants of the present invention.

The third riser panel 30 is shown in detail in FIGS. 2-4 as exemplary of the panels 22, 24, 26, 28, 30 and comprises substantially planar ends 32 and substantially planar sides 34 joined by longitudinal ribs 36 and transverse ribs 38, which are spaced from one another to form an open, grid-like structure. Some of the longitudinal ribs 36 have a height greater than others, as is shown at 36*a* and 36*b* in FIG. 4, and the transverse ribs 38 may be of uniform height, or of varying height, like the longitudinal ribs 36. The longitudinal ribs 36 and the transverse ribs 38 cooperate to provide a substantially planar top surface 39 for each of the panels 22, 24, 26, 28, 30. It should be understood, however, that the invention is not limited to panels 22, 24, 26, 28, 30 having an open, grid-like structure, but rather, the panels 22, 24, 26, 28, 30 could be provided with solid top surfaces, in which case the ribs 36, 38 would be replaced with a substantially planar surface.

At intervals, each panel 22, 24, 26, 28, 30 has a circular wall 40 which forms either an closed ended socket 42 or an open ended tubular sleeve 44. The circular walls 40 are arrayed both longitudinally and transversely on the panels 22, 24, 26, 28, 30 in transverse groupings that are longitudinally spaced from one another. The circular walls 40 which extend longitudinally of each panel 22, 24, 26, 28, 30 are aligned with one another and the sockets 42 and the sleeves 44 which extend transversely of each panel 22, 24, 26, 28, 30 also are aligned with one another. Accordingly, the transverse spacing between the sockets 42 and the sleeves 44 is uniform, and the longitudinal spacing between adjacent transverse groupings of the sockets 42 and the sleeves 44 is uniform. The sockets 42 and sleeves 44 are differentiated from one another by the presence or absence, respectively, of the ribs 36, 38 at one longitudinal end of the circular wall. Whether a particular circular wall 40 forms a socket 42 or a sleeve 44 depends upon the overall geometry and structure of the shelving unit 20, and thus depends on the location of that particular circular wall 40.

Figure 5:
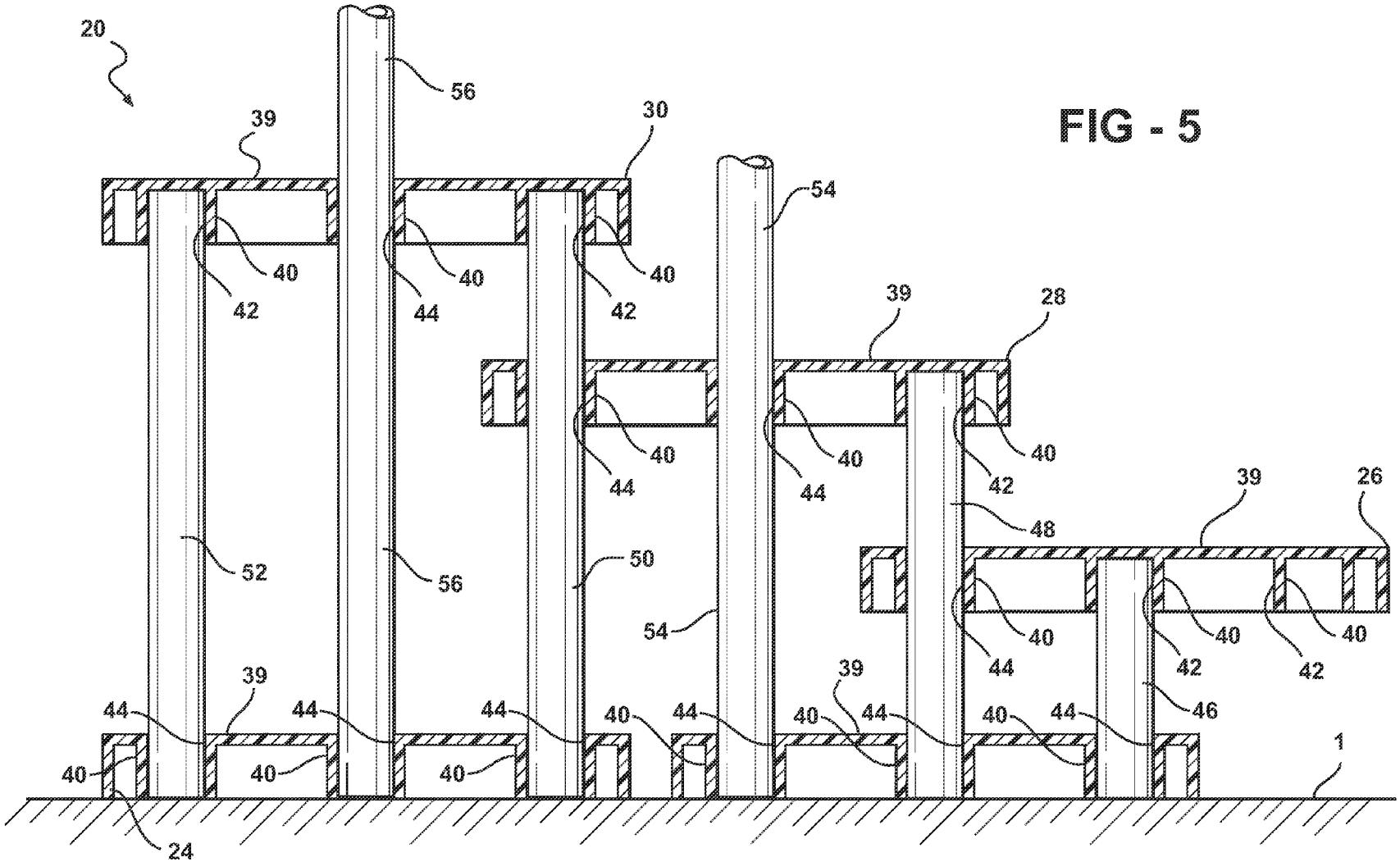
FIG. 5 is a section view of a shelving unit of the support structure for hanging plants of the present invention.

The geometric configuration of the shelving unit 20 provides a stable base from which the plant hanger assembly 60 is supported. As best shown in FIG. 5, the first base panel 22 and the second base panel 24 are positioned upon a support surface 1 with their sides 34 adjacent to one another and with their top surfaces 39 facing upward. The first base panel 22 and the second base panel 24 are each provided with transverse groupings of three sleeves 44.

The riser panels 26, 28, 30 are arranged in a stair-step configuration above the base panels 22, 24. In particular, the first riser panel 26, the second riser panel 28, and the third riser panel 30 are positioned with their top surfaces 39 facing upward, and are supported above and spaced from the first base panel 22 and the second base panel 24 by a plurality of support legs 46, 48, 50, 52. A lower end of each of the support legs 46, 48, 50, 52 is seated in one of the sleeves in either the first base panel 22 or the second base panel 24 and is in contact with the support surface 1. An upper end of each support leg is seated in one of the sockets 42 provided on one of the riser panels 26, 28, 30. The uprights 54, 56 are also seated in one of the sleeves 44 in either the first base panel 22 or the second base panel 24 and are in contact with the support surface 1. The uprights 54, 56 extend through at least one of the sleeves 44 in the riser panels 26, 28, 30 before continuing upward toward connection with the frames 62 of the plant hanger assembly 60. The lengths of the support legs 46, 48, 50, 52 may vary from one another based upon the relative heights of the riser panel 26, 28, 30 that a particular support leg 46, 48, 50, 52 is supporting with respect to the base panels 22, 24. However, the uprights 54, 56 are uniform in height, corresponding to the height at which the plant hanger assembly 60 is supported above the base panels 22, 24.

The first riser panel 26 is supported above and at least partially overlies the first base panel 22. The circular walls 40 of the first riser panel 22 form sockets 42 at the front and middle of the first riser panel 22, and form a sleeve 44 at the rear of the first riser panel 44. The lower end of the first support leg 46 is seated in the front sleeve 44 of the first base panel 22, and the upper end of the first support leg 46 is seated in the middle socket 42 of the first riser panel 26. The lower end of the second support leg 48 is seated in the middle sleeve 44 of the first base panel 22, and extends through the rear sleeve 44 of the first riser panel 26 at an intermediate point along the length of the second support leg 48. From the foregoing, it will be appreciated that the frontward portion of the first riser panel 26 extends forward of the first base panel 22.

The second riser panel 28 is supported above and at least partially overlies both the first base panel 22 and the second base panel 24. The circular walls 40 of the second riser panel 28 form a socket 42 at the front of the second riser panel 28, and form sleeves 44 at the middle and rear of the second riser panel 28. As stated previously, the lower end of the second support leg 48 is seated in the middle sleeve 44 of the first base panel 22. After passing through the rear sleeve 44 in the first riser panel 26, the second support leg 48 continues upward, and the upper end of the second support leg 48 is disposed in the front socket 42 of the second riser panel 28, thereby interconnecting the first riser panel 26 with the second riser panel 28. The lower end of the first upright 54 is disposed in the rear sleeve 44 in the first base panel 22, and extends through the middle sleeve 44 in the second riser panel 28 at an intermediate point along the length of the first upright 54. The lower end of the third support leg 50 is seated in the front sleeve 44 of the second base panel 24 and extends through the rear sleeve 44 of the second riser panel 28 at an intermediate point along the length of the third support leg 50. From the foregoing, it will be appreciated that the second riser panel 28 at least partially overlies the first riser panel 26.

The third riser panel 30 is supported above overlies the second base panel 24. The circular walls 40 of the third riser panel 30 form sockets 42 at the front and rear of the third riser panel 30, and form a sleeve 44 at the middle of the third riser panel 30. As stated previously, the lower end of the third support leg 50 is seated in the front sleeve 44 of the second base panel 24. After passing through the rear sleeve 44 in the second riser panel 28, the third support leg 50 continues upward, and the upper end of the third support leg 50 is disposed in the front socket 42 of the third riser panel 30, thereby interconnecting the second riser panel 28 with the third riser panel 30. The lower end of the second upright 56 is disposed in the middle sleeve 44 in the second base panel 22, and extends through the middle sleeve 44 in the third riser panel 28 at an intermediate point along the length of the second upright 56. The lower end of the fourth support leg 52 is seated in the rear sleeve 44 of the second base panel 24, and the upper end of the fourth support leg 52 is disposed in the rear socket 42 of the third riser panel 30. From the foregoing, it will be appreciated that the third riser panel 30 at least partially overlies the second riser panel 28.

Figure 6:
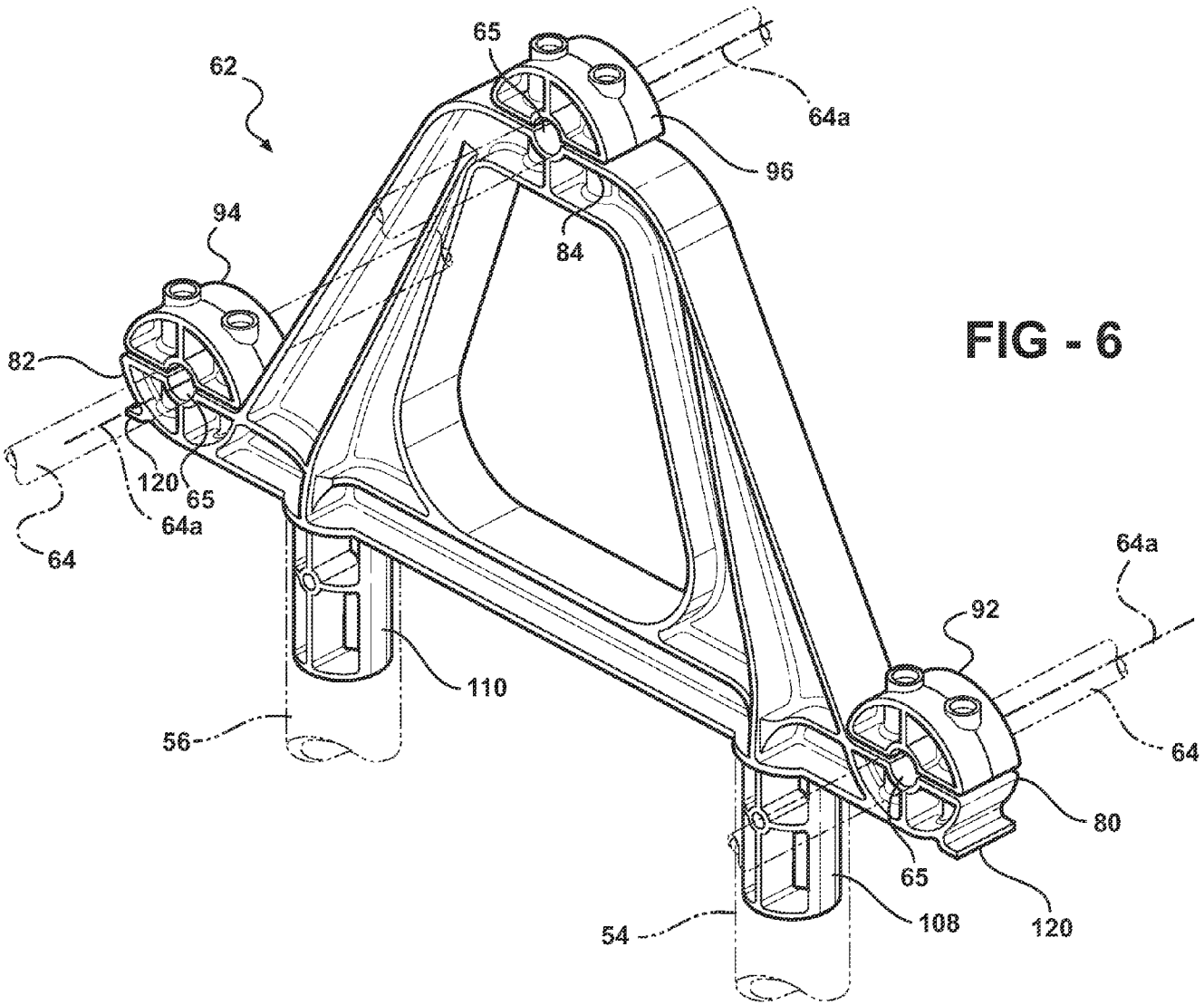
FIG. 6 is a detail view of a plant hanger assembly of the support structure for hanging plants of the present invention.

In order to suspend the hanging plants above the shelving unit 20 each frame 62 is connected to a pair of the uprights 54, 56, and the support rods 64 are supported between adjacent pairs of the frames 62, as shown in FIG. 6. As will be described in greater detail herein a first mounting member 108 and a second mounting member 110 are formed on each frame 62 for connection to the uprights 54, 56, and a first clamping site 80, a second clamping site 82, and a third clamping site 84 formed on each frame 62 and cooperate with a first clamping member 92, a second clamping member 94, and a third clamping member 96, respectively, to connect the frames 62 to the support rods 64.

The frames 62 are fabricated from a strong and durable plastic material, such as high density polyethylene, and may be formed by a number of well known methods, such as injection molding. Thus, each frame 62 may be molded as one-piece integral body, eliminating the need to assemble and disassemble the frames for storage. It should be appreciated however, that other materials and fabrication methods could be used to form the frames 62, and the frames need not necessarily be one-piece structures.

Figure 7:
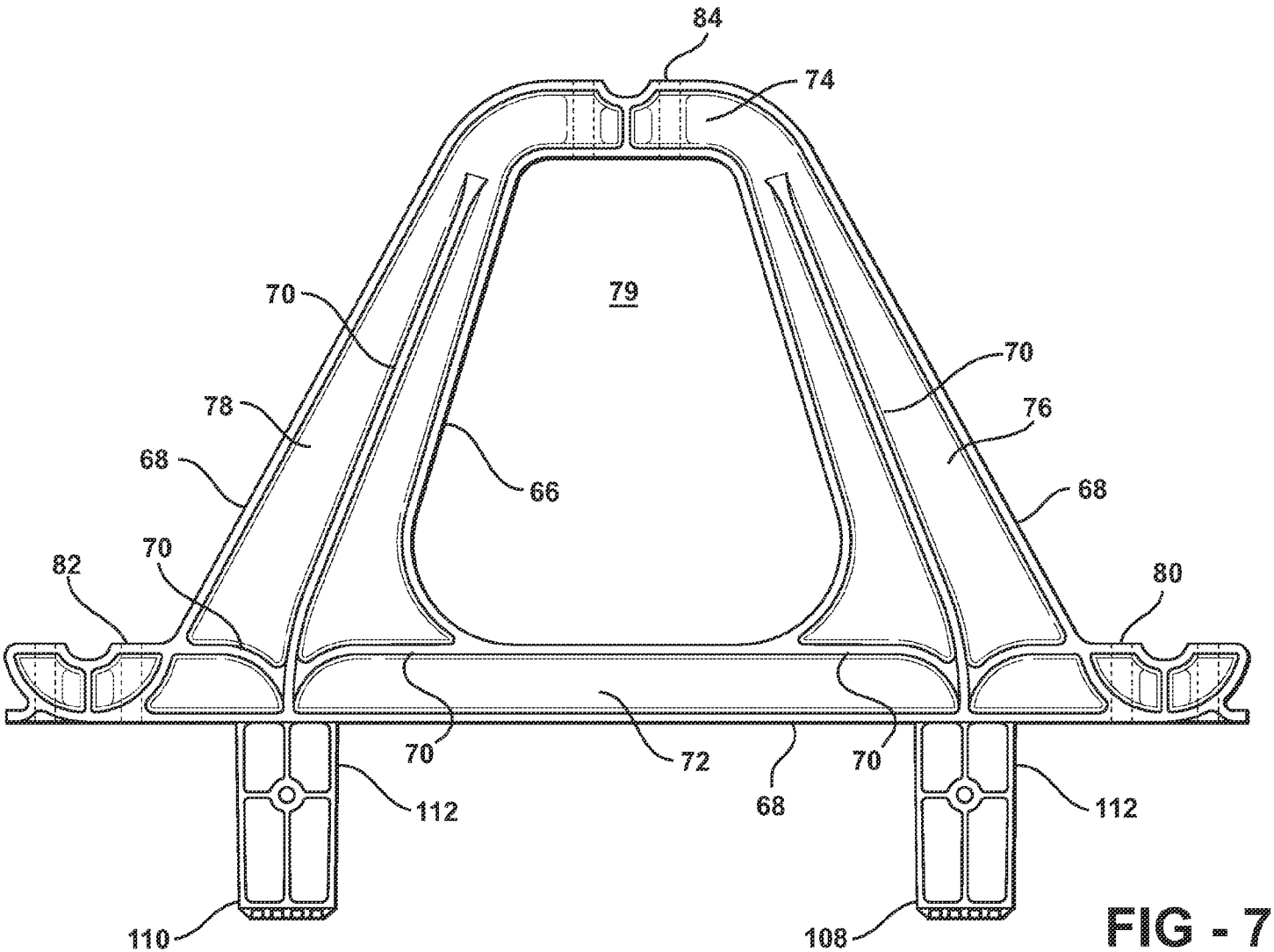
FIG. 7 is a side view of a frame of the plant hanger assembly.

In order to minimize weight, the frames 62 may include four main portions or beams that define an open framework having a substantially triangular or trapezoidal shape. As best seen in FIG. 7, a lower beam portion 72 and an upper beam portion 74 are substantially parallel to one another, and are spaced apart height-wise by a first side beam portion 76 and a second side beam portion 78. The upper beam portion 74 is shorter in length than the lower beam portion 72. Accordingly the first and second side beam portions 76, 78 connect to the lower beam portion 72 at acute interior angles, and at opposite ends of the lower beam portion 72. The first and second side beam portions 76, 78 connect to the upper beam portion 74 at obtuse interior angles, and at opposite ends of the upper beam portion 74. In this manner, the substantially triangular or trapezoidal shape of the frames 62 is established by the lower beam portion 72, the upper beam portion 74, the first side beam portion 76, and the second side beam portion 78.

In order to form a stable base for the each frame 62, the lower beam portion 72 extends substantially horizontally near the bottom of the frame 62. The first clamping site 80 is formed on the lower beam portion 72 at one end thereof, and the second clamping site 82 is formed on the opposite end of the lower beam portion 72. The first mounting member 108 and the second mounting member 110 are connected to the lower beam portion 72 at spaced locations along the lower beam portion 72. The upper beam portion 74 of the frame is substantially parallel to the lower beam portion 72 and located above the lower beam portion 72. The third clamping site 84 is formed on the upper beam portion 74 at an intermediate location on the upper beam portion 74. The first side beam portion 76 and the second side beam portion 78 are connected to the upper beam portion 74 at opposite ends of the upper beam portion 74. The first side beam portion 76 and the second side beam portion 78 are also connected to the lower beam portion 78 opposite the upper beam portion 74, and thus the first side beam portion 76 and the second side beam portion 78 space the upper beam portion 74 from the lower beam portion 72. The first side beam portion 76 and the second side beam portion 78 are spaced with respect to one another along the lower beam portion 74. In particular, the first side beam portion 76 meets the lower beam portion 72 adjacent to the first clamping site 80 and the first mounting member 108, while the second side beam portion 78 meets the lower beam portion 72 adjacent to the second clamping site 82 and the second mounting member 110. From the foregoing, it will be appreciated that the lower beam portion 72, the upper beam portion 74, the first side beam portion 76 and the second side beam portion 78 cooperate to form a closed figure, and define an opening 79 in the frame 62.

In order to enhance the rigidity of the frame 62, a plurality of support ribs 66, 68, 70 may be formed on the frame 68 and extend substantially perpendicular to the lower beam portion 72, the upper beam portion 74, the first side beam portion 76 and the second side beam portion 78. In particular, inner support ribs 66 and outer support ribs 68 are formed on inner and outer edges of the frame 62, while intermediate support ribs 70 are located on or between the beam portions 72, 74, 76, 78 of the frame. Although provision of the support ribs 66, 68, 70 adds significantly to the strength to the frame 62 without adding needless mass, it should be appreciated that the invention is not limited to this particular structure, and the frame 62 may be strengthened by structures other than the support ribs 66, 68, 70.

Figure 8B:
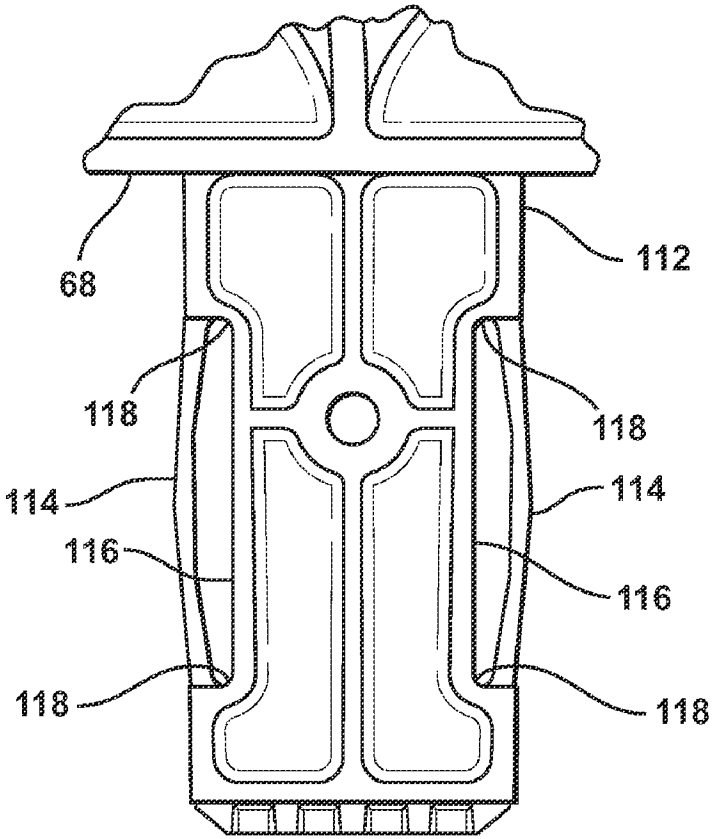
FIG. 8B is a side view of an alternative embodiment of the mounting member of the frame of the plant hanger assembly.
Figure 8A:
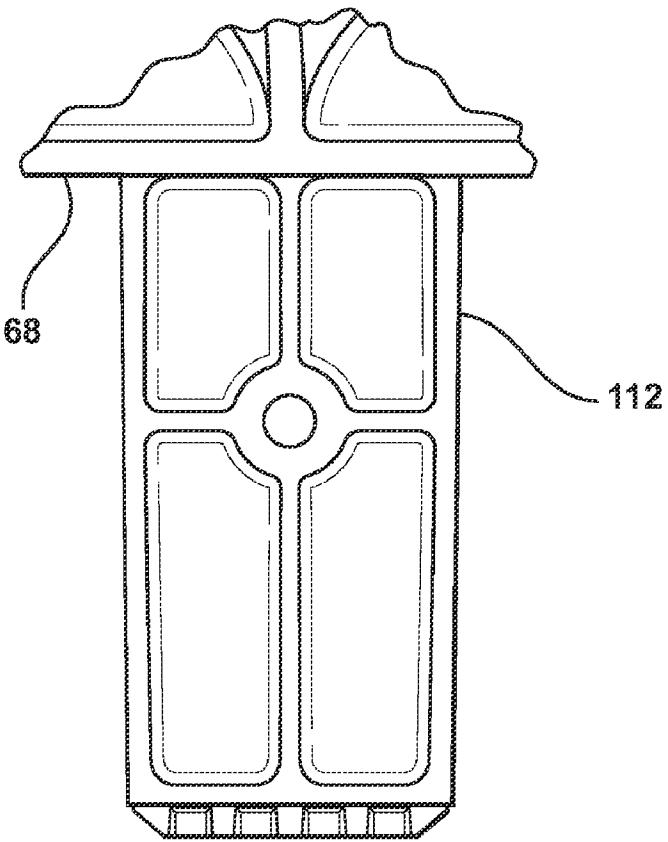
FIG. 8A is a side view of a mounting member of the frame of the plant hanger assembly.

In order to supportably connect the frames 62 to the uprights 54, 56 of the shelving unit 20, the first mounting member 108 and the second mounting member 110 are formed on each frame 62. As best seen in FIG. 8, the mounting members 108, 110 each have a tubular body 112 that extends downward from the lower beam portion 72 of the frame 62, and thus, over-insertion of the first and second mounting members 108, 110 is prevented by contact of the ends of the uprights 54, 56 with the peripheral support ribs 68 of the lower beam portion 72 of the frame 62. The tubular body 112 has an outside diameter that is just smaller than the inside diameter of the first and second uprights 54, 56 so that the first and second mounting members 108, 110 may be received within the first and second uprights. Furthermore, the tubular bodies 112 of the first and second mounting members 108, 110 may be contoured or otherwise structured to establish a friction fit between the mounting members 108, 110 and the uprights 54, 56, respectively. Alternatively, a resilient flange 114 may be provided on each tubular body 112, to create an enhanced friction fit between the mounting members 108, 110 and the uprights 54, 56, as shown in FIG. 8B. The resilient flange 114 extends diametrically outward from the tubular body 112, and is compressed radially inward upon insertion of the mounting member 108, 110 into a respective upright 54, 56. In particular, a recess 116 having opposed end walls 118 is provided on the tubular body 112 to accommodate deformation of the resilient flange 114, and the resilient flange 114 may be connected to the tubular body 112 at the opposed end walls 118 of the recess 116. Furthermore, each tubular body 112 may have a single resilient flange 114, or two or more resilient flanges 114.

In order to suspend the hanging plants above the shelving unit 20 on the horizontal support rods 64, the first clamping site 80, the second clamping site 82, and the third clamping site 84 are formed on each frame 62. Each of the clamping sites 80, 82, 84 is characterized by a substantially planar engagement surface 85 having a semi-circular channel 84 formed thereon. The semi-circular channels 86 are sized to receive the support rods 64, and apertures 87 straddle each semi-circular channel 86 and extend substantially perpendicular to the longitudinal rod axis 64*a* of each rod 64 to accommodate attachment of the clamping members 92, 94, 96, as will be described in detail herein. Also, a retainer 120 is formed on each of the first and second clamping sites 80, 82, as will be described further herein.

Figure 9:
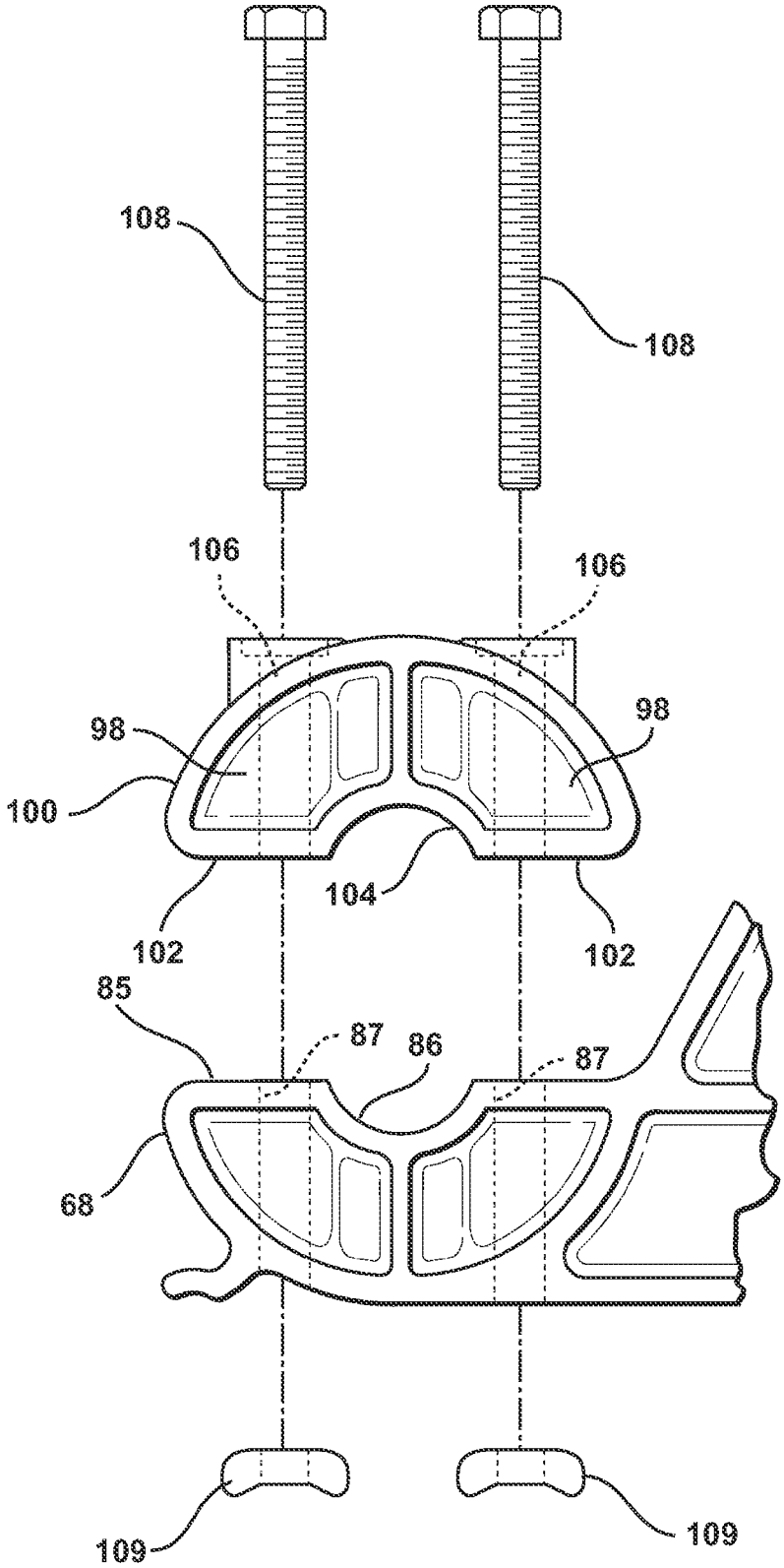
FIG. 9 is a side view of a clamping site of the frame of the plant hanger assembly and a clamping member of the plant hanger assembly.

Each of the clamping members 92, 94, 96 cooperates with a respective clamping site 80, 82, 84 to define a rod aperture 65 at each clamping site 80, 82, 84, in which the support rods 64 are received and retained. The clamping members 92, 94, 96 are constructed in a manner that is similar to that of the frames 62. In particular, each clamping member has a body portion 98 and a peripheral support rib 100. To cooperatively engage the clamping sites 80, 82, 84, each clamping member 92, 94, 96 includes a substantially planar engagement surface 102 having a semi-circular channel 104 formed thereon, as best seen in FIG. 9, where the second clamping site 82 and the second clamping member 94 are shown in detail as exemplary of the clamping sites 80, 82, 84 and the clamping members 92, 94, 96. The semi-circular channels 104 are sized to receive the support rods 64, and cooperate with the semi-circular channels 86 in the clamping sites 80, 82, 84 to define the rod apertures 65. In similar manner as described with respect to the clamping sites 80, 82, 84, apertures 106 straddle the semicircular channel 104 of each clamping member 92, 94, 96 and thus, when assembled, extend substantially perpendicular to the longitudinal rod axis 64*a* of each rod 64. Furthermore, when the clamping members 92, 94, 96 are engaged with a respective clamping site 80, 82, 84, the apertures 87 in the clamping sites align with the apertures 106 in the clamping members 92, 94, 96 so that fasteners, such as bolts 108 and nuts 109, may extend through the apertures 87, 106 to secure each of the clamping members 92, 94, 96 to a respective clamping site 80, 82, 84, and thus secure the support rods 64 with respect to the frames 62.

Figure 10:
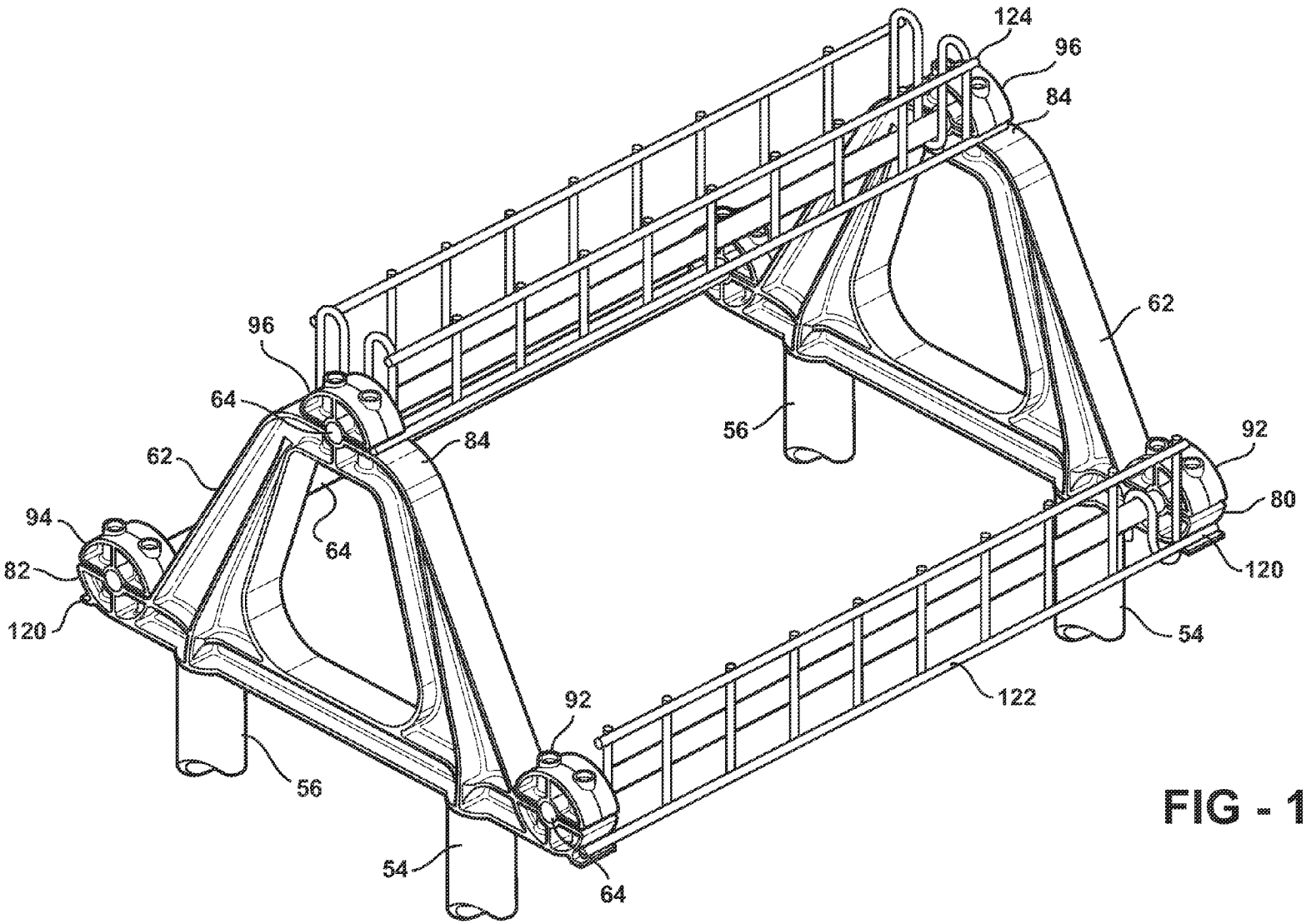
FIG. 10 is a perspective view of the plant hanger assembly showing a first rack and a second rack installed thereon.

In order to provide supplemental structures by which articles may be hung upon the support structure for hanging plants 10, one or more racks 122, 124 may be connected to the plant hanger assembly 60, as shown in FIG. 10. The racks 122, 124 are structures upon which articles or signs can be hung, such as hanging wire grids or wire slat hook racks. A first rack 122 is mounted to the support rods 64 that extend between either the first or second clamping sites 80, 82, and is mounted to the retainers 120 to stabilize the first rack 122 against rotation. A second rack 124 is mounted to the support rods 64 that extend between the third clamping sites 84, and portions of the second rack 124 are clamped between the third clamping sites 84 and the third clamping members 96 to further support the second rack and brace it against rotation.

In use, the support structure 10 for hanging plants is assembled by first constructing the shelving unit 20, and then supporting the plant hanger assembly 60 above the shelving unit 20 using the uprights 54, 56. The support rods 64 are laid between the frames 62 on the clamping sites 80, 82, 84, and connected thereto using the clamping members 92, 94, 96. Then, hanging plants may be supported on the support rods 64.

While the invention has been described in connection with what is presently considered to be the most practical and preferred embodiment, it is to be understood that the invention is not to be limited to the disclosed embodiments, but on the contrary, it is intended to cover various modifications and equivalent arrangements included within the spirit and scope of the appended claims. The scope is to be accorded the broadest interpretation so as to encompass all such modifications and equivalent structures as is permitted under the law.

What is claimed is:

1. A support structure for hanging plants, comprising:

a plurality of frames having a plurality of clamping sites formed thereon, each clamping site defining a first portion of a rod aperture of a plurality of rod apertures, and a plurality of mounting members formed thereon, each mounting member connectable to an upper end of an upright elongate support member;

a plurality of rods for suspending the hanging plants therefrom, wherein each rod is supported by each frame at a respective one of the clamping sites;

a plurality of clamping members on each frame defining a second portion of a respective one of the rod apertures, each clamping member moveable between a disconnected position with respect to the frame, and a connected position with respect to the frame, wherein the first and second portions of each rod aperture face one another and the rods are each secured between one of the clamping sites and one of the clamping members for securing the plurality of rods with respect to the frame each of the plurality of frames is substantially triangular, having an upper and a lower beam that is wider that the upper beam, wherein first and second clamping sites of the plurality of clamping sites are formed on opposite ends of the lower beam, a third clamping site of the plurality of clamping sites is formed on the upper beam, and the mounting members extend downward from a bottom surface of the lower beam.

2. The support structure for hanging plants stated in claim 1, wherein the mounting members of the plurality of frames are connectable to the upper ends of the elongate support members by friction fit.

3. The support structure for hanging plants stated in claim 1, further comprising:

a resilient flange formed on each mounting member for frictionally engaging a respective elongate support member of the plurality of elongate support members, the resilient flange extending from a first end that is connected to a body portion of the mounting member to a second end that is connected to the body portion of the mounting member, wherein an intermediate portion of the resilient flange is located between the first and second ends and is spaced from the body portion of the mounting member for resilient deformation with respect thereto.

4. The support structure for hanging plants stated in claim 1, wherein the plurality of clamping sites comprises at least three clamping sites spaced from one another in a substantially triangular configuration.

5. The support structure for hanging plants stated in claim 1, wherein the plurality of rods are substantially horizontal.

6. The support structure for hanging plants stated in claim 1, wherein the plurality of frames are is fabricated as an integrally formed molded plastic body, and each clamping member is formed as a separate integrally formed molded plastic body.

7. A support structure for hanging plants, comprising:

a plurality of frames, each being substantially triangular, fabricated as integrally formed molded plastic bodies each having a plurality of clamping sites formed thereon and a plurality of mounting members formed thereon;

a plurality of rods for suspending the hanging plants therefrom, wherein at least two frames of the plurality of frames supportingly engage each rod;

a plurality of clamping members fabricated as integrally formed molded plastic bodies each removably connectable to a respective clamping site of the plurality of clamping sites to clamp each rod between one of the clamping sites of each frame and a corresponding one of the clamping members at each clamping site for securing the plurality of rods with respect to the plurality of frames; and a plurality of elongate support members, each having an upper end and a lower end, wherein the mounting members of the frames are connected to the upper ends of the elongate support members by frictional engagement.

8. The support structure for hanging plants stated in claim 7, wherein the plurality of clamping sites comprises at least three clamping sites spaced from one another in a substantially triangular configuration.

9. The support structure for hanging plants stated in claim 7, wherein the plurality of elongate support members are substantially upright.

10. The support structure for hanging plants stated in claim 9, wherein the plurality of rods are substantially perpendicular to the plurality of elongate support members.

11. The support structure stated in claim 7, wherein the plurality of mounting members comprises at least two mounting members spaced from one another on a bottom portion of each frame.

12. A support structure for hanging plants, comprising:

a plurality of substantially triangular frames fabricated as integrally formed molded plastic bodies each having a plurality of clamping sites formed on each frame and a pair of mounting members formed on a bottom portion of each frame;

a plurality of rods for suspending the hanging plants therefrom, wherein at least two frames of the plurality of frames supportingly engage each rod;

a plurality of clamping members fabricated as integrally formed molded plastic bodies each removably connectable to a respective clamping site of the plurality of clamping sites to clamp each rod between one of the clamping sites of each frame and a corresponding one of the clamping members at each clamping site for securing the plurality of rods with respect to the plurality of frames;

a plurality of elongate support members, each substantially upright and each having an upper end and a lower end, wherein the mounting members of the frames are connected to the upper ends of the elongate support members by frictional engagement;

a plurality of base panels for supporting contact with a support surface, wherein each elongate support member is connected to a respective base panel of said plurality of base panels at a lower end of each elongate support member;

a plurality of riser panels wherein each elongate support member is in engagement with a respective riser panel of the plurality of riser panels at an intermediate point on each elongate support member to restrain the elongate support members against rotation with respect to the base panels; and a plurality of support legs for spacing the plurality of riser panels from the plurality of base panels.

13. The support structure for hanging plants stated in claim 12, wherein the plurality of clamping sites has at least three clamping sites spaced from one another in a substantially triangular configuration.

14. The support structure for hanging plants stated in claim 12, further comprising:

a pair of fasteners removably connectable to each clamping member and each said clamping site to secure each clamping member to a respective clamping site of the plurality of clamping sites, wherein each clamping member cooperates with a respective clamping site of the plurality of clamping sites to define a substantially cylindrical rod apertures through which the support rods extend and wherein the pair of fasteners straddle a respective rod aperture of the plurality of rod apertures.

15. The support structure for hanging plants stated in claim 12, further comprising:

at least one rack connected to a rod of the plurality of rods.

* * * * *